US008671697B2

(12) United States Patent
Zimmerman et al.

(10) Patent No.: US 8,671,697 B2
(45) Date of Patent: Mar. 18, 2014

(54) PUMPING SYSTEM RESISTANT TO CAVITATION

(75) Inventors: Sammy Lee Zimmerman, Genesse, ID (US); Charles L Tilton, Colton, WA (US)

(73) Assignee: Parker-Hannifin Corporation, Cleveland, OH (US)

( * ) Notice: Subject to any disclaimer, the term of this patent is extended or adjusted under 35 U.S.C. 154(b) by 599 days.

(21) Appl. No.: 12/961,957

(22) Filed: Dec. 7, 2010

(65) Prior Publication Data

US 2012/0138272 A1 Jun. 7, 2012

(51) Int. Cl.

| | |
|---|---|
| ***F25B 21/02*** | (2006.01) |
| ***F25B 49/00*** | (2006.01) |
| ***F25B 41/00*** | (2006.01) |
| ***F28D 15/00*** | (2006.01) |
| ***F28F 7/00*** | (2006.01) |
| ***F04B 49/06*** | (2006.01) |

(52) U.S. Cl.

USPC ..... 62/3.7; 62/3.2; 62/228.5; 62/228.3; 62/513; 62/3.1; 62/3.3; 62/3.4; 62/3.5; 62/3.6; 165/104.33; 165/185; 417/44.1; 417/313; 417/45; 310/306; 310/318

(58) Field of Classification Search

USPC ..... 62/3.2, 228.5, 228.3, 513, 3.1–3.7; 165/104.33, 185; 417/44.1, 313, 45; 310/306, 318

See application file for complete search history.

(56) References Cited

U.S. PATENT DOCUMENTS

| | | | | |
|---|---|---|---|---|
| 3,073,575 | A | 1/1963 | Schulenberg | |
| 3,710,854 | A | 1/1973 | Staub | |
| 4,300,481 | A | 11/1981 | Fisk | |
| 4,352,392 | A | 10/1982 | Eastman | |
| 5,220,804 | A | 6/1993 | Tilton et al. | |
| 5,333,677 | A | 8/1994 | Molivadas | |
| 5,522,452 | A | 6/1996 | Mizuno et al. | |
| 6,104,610 | A | 8/2000 | Tilton et al. | |
| 6,105,373 | A | 8/2000 | Watanabe et al. | |
| 6,139,361 | A | 10/2000 | Przilas et al. | |
| 6,270,015 | B1 * | 8/2001 | Hirota | 237/12.3 B |
| 6,437,983 | B1 | 8/2002 | Machiroutu et al. | |
| 6,580,610 | B2 | 6/2003 | Morris et al. | |
| 6,646,879 | B2 | 11/2003 | Pautsch | |
| 6,663,349 | B1 * | 12/2003 | Discenzo et al. | 417/44.1 |
| 6,766,817 | B2 | 7/2004 | da Silva | |
| 6,976,528 | B1 | 12/2005 | Tilton et al. | |
| 6,990,816 | B1 * | 1/2006 | Zuo et al. | 62/3.7 |
| 7,342,787 | B1 * | 3/2008 | Bhatia | 361/700 |
| 7,779,896 | B2 * | 8/2010 | Tilton et al. | 165/104.31 |

(Continued)

FOREIGN PATENT DOCUMENTS

CN 1734212 A * 2/2006

*Primary Examiner* — Frantz Jules
*Assistant Examiner* — Erik Mendoza-Wilkenfel
(74) *Attorney, Agent, or Firm* — Lee & Hayes, PLLC

(57) ABSTRACT

Techniques herein describe a pumping system, adapted to reduce or eliminate fluid cavitation. Optionally, the pumping system is adapted for application to a passive fluid recovery system. In one example, the pumping system includes a pump and a thermal sub-cooling device. The thermal sub-cooling device may sub-cool fluid input to a pump and heat fluid output from the pump, particularly under start-up conditions. In a further example, a controller manages power supplied to both the pump and the thermal sub-cooling device, to transition from an ambient temperature start-up condition to an elevated temperature operating condition.

17 Claims, 11 Drawing Sheets

(56) References Cited

U.S. PATENT DOCUMENTS

2001/0002541 A1 6/2001 Patel et al.
2002/0113141 A1 8/2002 Malone et al.
2005/0168948 A1 8/2005 Cader et al.
2008/0196432 A1 * 8/2008 Shimamoto et al. ..... 62/238.7

* cited by examiner

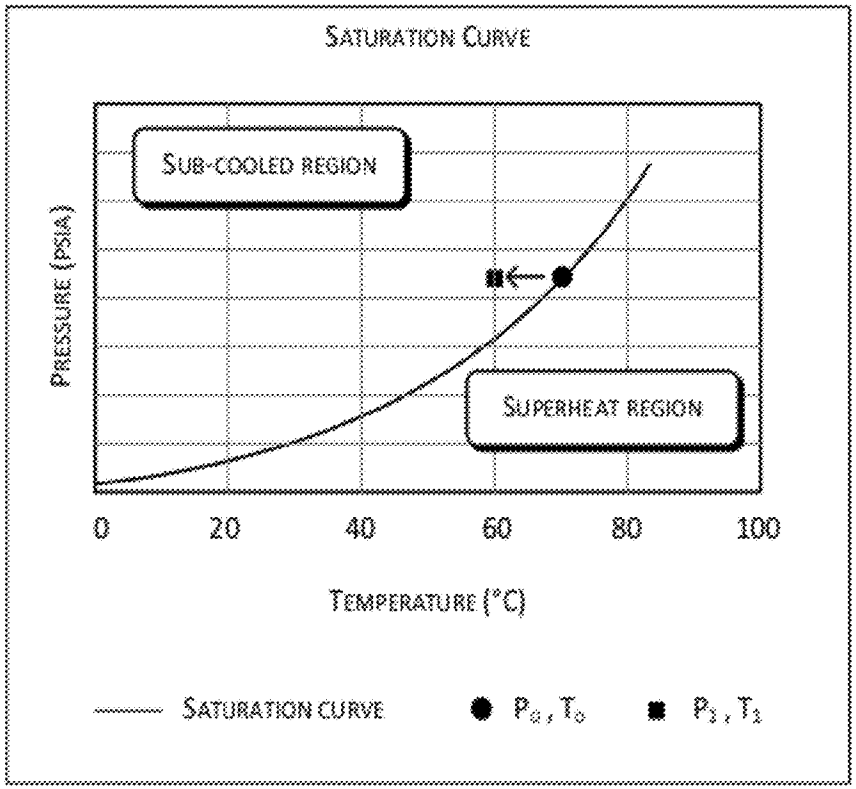
FIG. 2
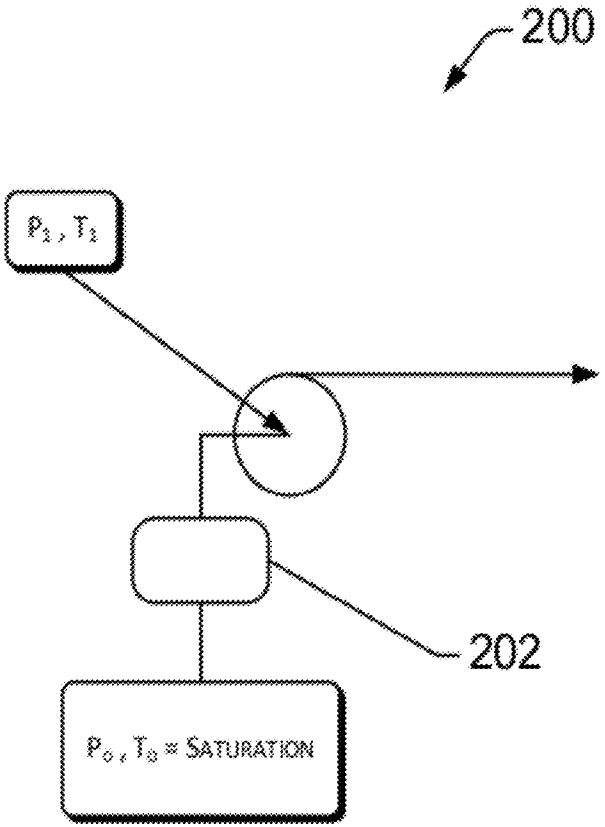

PUMPING SYSTEM RESISTANT TO CAVITATION

BACKGROUND

Fluid cooled systems may use a phase change of a fluid to move heat from one location or object to another. As a liquid becomes a gas, it absorbs heat energy. The gas may then be exhausted to a heat exchanger, where the gas is condensed to liquid form and heat is removed. The liquid may then be returned to the area from which heat is to be extracted.

In specialized fluid cooled systems, such as spray cooling of an electronic system adapted for attitude independent applications in avionics, it may be possible to passively remove fluid from an enclosure of the electronic system. Such passive fluid recovery systems have many advantages, such as elimination of complex valve systems that are present in active fluid recovery systems. However, during operation of a passive fluid recovery system, a mixture of gas and liquid is removed from the enclosure.

This mixture of gas and liquid may present difficulties within a passive fluid recovery system. For example, during a start-up of the system, it may be difficult to pump the mixture. Even when the fluid at a pump inlet is substantially liquid, operation of the pump may lower pressure sufficiently to introduce a vapor component to the fluid. Such vapor may cause failure and/or reduced effectiveness of the pump. Accordingly, advancements in pumping systems would be welcome.

SUMMARY

Techniques herein describe a pumping system, adapted to reduce or eliminate inertial, impeller or pump cavitation. Optionally, the pumping system is adapted for application to a passive fluid recovery system. In one example, the pumping system includes a pump and a thermal sub-cooling device. The thermal sub-cooling device, which may be implemented as a thermo-electric cooler or alternate device, sub-cools fluid input to a pump under start-up conditions. In a further example, a controller manages power supplied to both the pump and the thermal sub-cooling device, to transition from an ambient temperature start-up condition to an elevated temperature operating condition.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The term "techniques," for instance, may refer to device(s), system(s), method(s) and/or computer-readable instructions as permitted by the context above and throughout the document.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

FIGS. 1-3 illustrate three example configurations wherein net positive inlet pressure at a pump inlet may be maintained at a level higher than net positive inlet pressure required.

DETAILED DESCRIPTION

Figure 1:
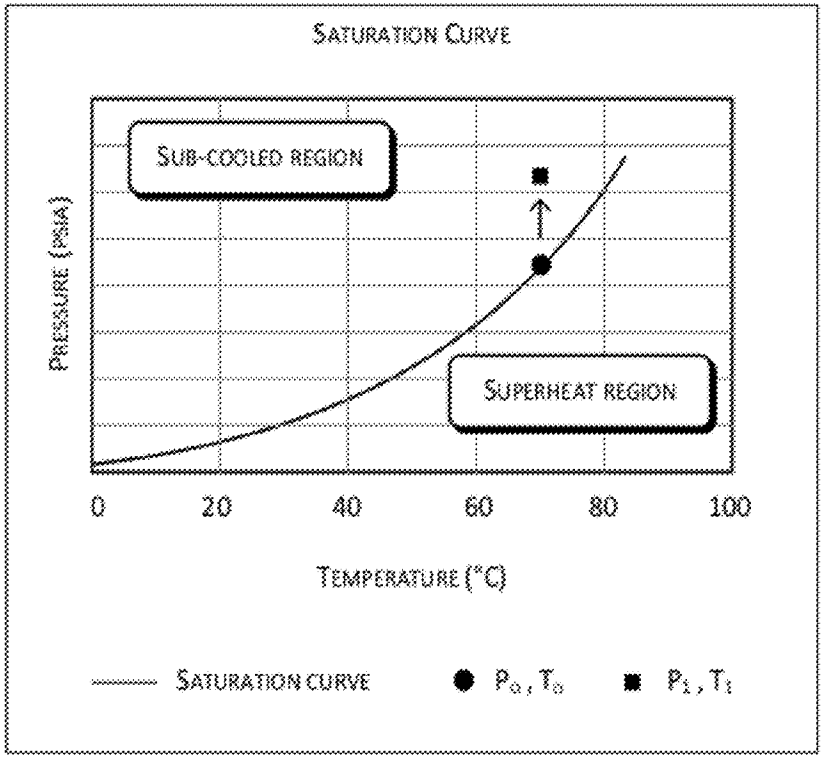
Figure 1:
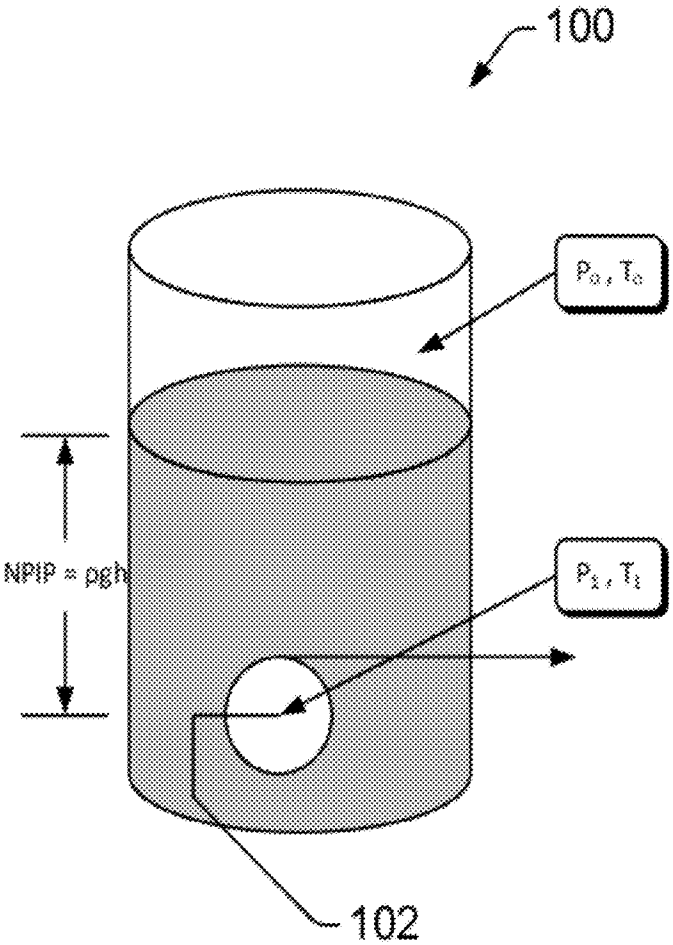

A pumping system, adapted to reduce or eliminate inertial, impeller or pump cavitation is described herein. The pumping system may be adapted for application to a passive fluid recovery system or other system, as indicated by design needs. In one example, the pumping system includes a pump and a thermal sub-cooling device. The thermal sub-cooling device may be implemented as a thermo-electric cooler (TEC) or alternate device. The thermal sub-cooling device sub-cools fluid input to a pump under start-up conditions. Sub-cooling allows some reduction of pressure on the fluid, by action of the pump, while keeping the fluid at pressure greater than the vapor pressure. In a further example, a controller manages power supplied to both the pump and the thermal sub-cooling device, to transition from a start-up condition wherein an entire system may be at a uniform initial temperature to an operating condition wherein system temperature is not uniform.

Within an example system, a pump is operated in combination with a thermal sub-cooling device, and a controller to coordinate the operation of both. The thermal sub-cooling device may be adapted for operation, such as during start-up or other critical times during operation, when a heat exchanger or radiator is not adequately functional. For example, a heat exchanger or radiator may not function adequately prior to establishment of a temperature differential between different parts of the system. During a start-up phase, the system transitions from an ambient starting temperature to operational conditions. In some example applications, the ambient temperature is cooler than the operational temperature. The thermal sub-cooling device includes a cooled portion, which may be connected to the pump inlet, and a heated portion, which may be connected to the pump outlet. Fluid is cooled before entering the pump, moving the fluid into a sub-cooled state wherein lessening of pressure drawing fluid into the pump does not result in formation of vapor bubbles. Accordingly, the pump may drive the fluid in a liquid state through the heated portion of the thermal sub-cooling device to atomizers elsewhere within the system. Return of this heat energy, together with inefficiencies or waste heat from the thermal sub-cooling device, tends to raise the temperature of a system within which the pump and thermal sub-cooling device are located. Such temperature elevation allows an incremental increase in power supplied to the pump and an incremental decrease in power supplied to the thermal sub-cooling device. At the conclusion of a start-up phase, power to the pump may be elevated, power to the thermal sub-cooling device may be reduced, and the overall system temperature may be significantly greater than the initial ambient temperature.

The discussion herein includes several sections. Each section is intended to be non-limiting; more particularly, this entire description is intended to illustrate components which may be utilized in a pumping system, but not components which are necessarily required. The discussion begins with a section entitled "Discussion of Fluid in a Cooling System," which describes aspects of fluid, particularly in relation to gas-liquid phase changes. Such relationships are important, in part because of the need to maintain the fluid within a pump in a liquid phase, to prevent pump cavitation. Next, a section entitled "Example Pumping Systems" illustrates four examples that are representative of pumping systems, particularly as adapted for use in a passive fluid return system. A further section, entitled "Further Discussion of Fluid in a Cooling System," describes aspects of fluid behavior within the example pumping systems. A still further section, entitled "Example Operational Algorithms" illustrates and describes techniques that may be used by example pumping systems, particularly including start-up algorithms and operational algorithms. Finally, the discussion ends with a brief conclusion.

This brief introduction, including section titles and corresponding summaries, is provided for the reader's convenience and is not intended to limit the scope of the claims or any section of this disclosure.

Discussion of Fluid in a Cooling System

A saturated liquid is a liquid having a pressure and temperature such that a slight increase in energy (through the addition of heat) or decrease in pressure results in phase change of a portion of the liquid into saturated vapor. Conversely, a decrease in energy (through the removal of heat) or an increase in pressure will result in saturated vapor returning the state of saturated vapor. The specific relationship between the saturation temperature and pressure of a fluid is referred to as the vapor-pressure curve. However, to move fluid, pumps lower the pressure at their inlet to draw fluid into the inlet. Accordingly, gas bubbles may appear within the fluid at pump inlets. The formation of these bubbles defines the onset of cavitation, and a decrease in pump performance will result unless the gas bubbles are collapsed prior to entering the pump.

Accordingly, pumping saturated liquids is difficult because the pump inlet pressure drop causes the liquid to partially vaporize as it inters the pump. The pump cannot deliver an adequate mass flow rate, or pressurize the output fluid sufficiently. When the pump is part of a spray cooling system, a low pump output pressure results in very poor or no spray development, and fluid may not be discharged from the atomizers adequately. Without proper fluid spray and atomization, the payload electronics cannot be energized because they would overheat.

To prevent the liquid from vaporizing in the pump inlet path, sub-cooling is required. Sub-cooling is the term applied when the fluid condition is moved away from the vapor-pressure curve through either a reduction in temperature or an increase in pressure of a liquid, so that the liquid can be lowered in pressure at the pump inlet without (1) causing vapor bubbles to form within the liquid, and (2) causing pump cavitation caused by gas within the pump.

The difference in pressure between the pump inlet pressure and the vapor pressure for the fluid is the net positive inlet pressure required (NPIPR). To prevent cavitation, the net positive inlet pressure (NPIP) must be greater than or equal to the NPIPR. That is, the inlet pressure of fluid entering a pump must be greater than the pressure at which the fluid would change phase from liquid to gas. Stated differently, the pressure at the pump inlet must be sufficiently great to prevent the fluid from boiling, even when the pressure is lowered somewhat, due to operation of the pump. This must be true at both start-up ambient temperatures and at operating temperatures.

Figure 3:
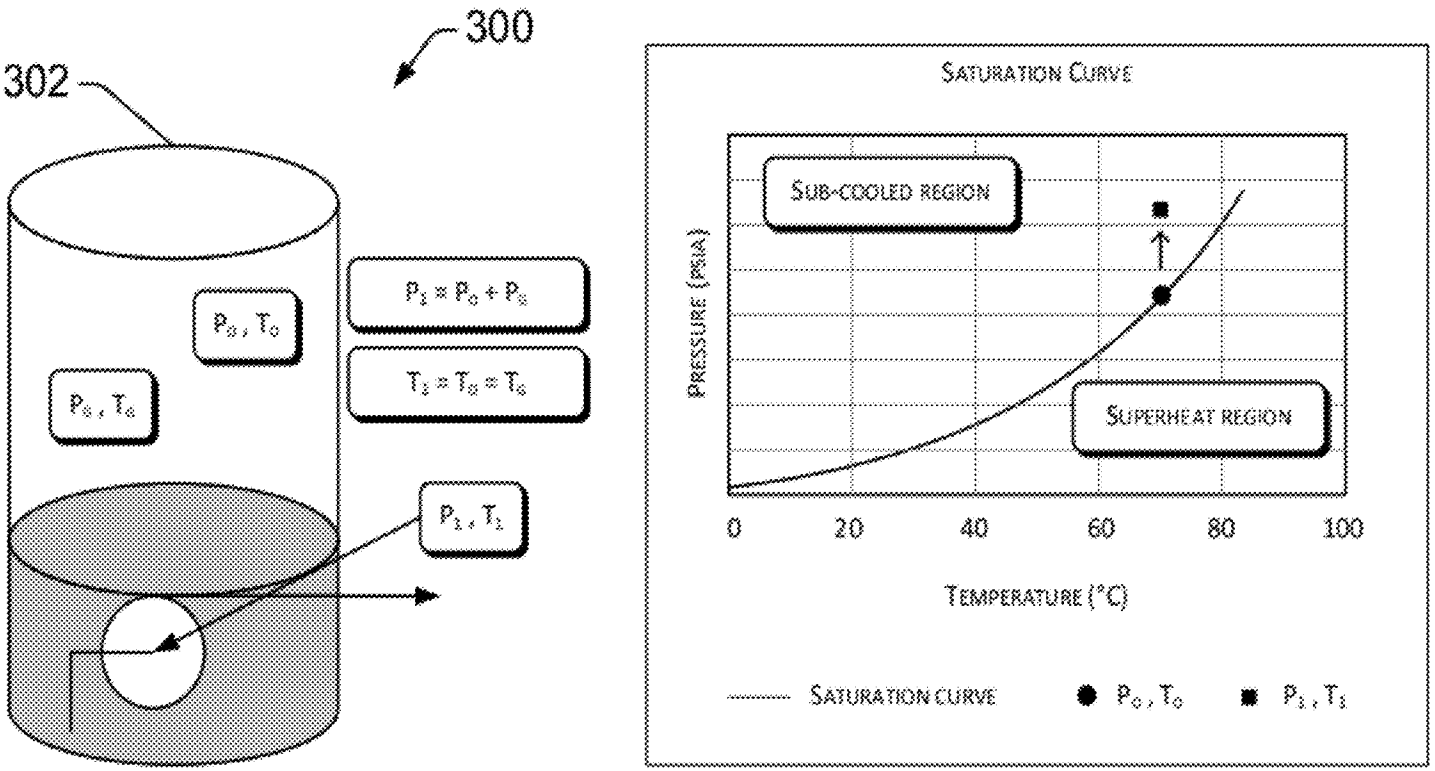

FIGS. 1-3 illustrate three configurations, techniques and/or methods wherein net positive inlet pressure at a pump inlet may be maintained at a level higher than net positive inlet pressure required. In FIGS. 1-3, $P_0$ and $T_0$ are the saturation pressure and temperature. Referring to FIG. 1, the first method utilizes a static head to elevate pressure in the fluid to avoid formation of gas bubbles and pump cavitation. In particular, the pump may be located some distance below (in relation to the local gravity vector) a liquid reservoir. Because the pump is located below the reservoir, additional pressure is applied to fluid at the pump inlet. Static head may be available for stationary systems. However, static head is usually not available and/or dependable if the pumping system is contained within a mobile spray cooled chassis. The mobility of such a chassis and associated packaging constraints, together with the variable chassis orientation in relation to gravity, may render this method ineffective. Using the static head will not affect the saturation temperature, heat exchanger performance, or the condensing temperature. Static head utilization could increase system size and weight, and always reduces the chassis mobility spectrum.

FIG. 1 shows an example configuration or system 100 wherein net positive inlet pressure is provided using a static head, and $T_0=T_1$ is and $P_0<P_1$. Thus, pressure on the fluid is increased at an inlet 102 to a pump, due to the fluid above the inlet. However, the temperature is uniform throughout the system 100. Such a configuration allows pressure at a pump inlet 102 to be maintained at a level higher than net positive inlet pressure required, thereby preventing pump cavitation. As seen in FIG. 1, the fluid has a NPIP=rho*g*h, where rho is a constant related to the fluid, g is gravity and h is height. Within the container, gaseous fluid is at pressure $P_0$ and temperature $T_0$. Fluid released from the container is at pressure $P_1$ and temperature $T_1$. Because of the action of gravity on the fluid, $P_1$ is greater than $P_0$, and thus the pressure of the fluid released through the opening of the container is of pressure higher than the gas above the liquid. Thus, referring to the graph of FIG. 1, the fluid at $P_1$, $T_1$ is in the sub-cooled region. Accordingly, it will resist a phase change from liquid to gas. Thus, if the fluid at $P_1$, $T_1$ is moved into a pump inlet having a pressure reduction of less than rho*g*h, no phase change from liquid to gas will result and no pump cavitation will result.

FIG. 2 illustrates aspects of a second system 200 and method of producing net positive inlet pressure (NPIP). FIG. 2 shows an example configuration wherein net positive inlet pressure is provided using thermal sub-cooling device 202. The sub-cooling device lowers fluid temperature, so that: $T_0>T_1$ is and $P_0=P_1$. Thus, the fluid is cooled, but the pressure is maintained. Sub-cooling involves reducing the temperature of the liquid, while the pressure may remain constant. Once sub-cooled, some reduction of pressure (such as caused by a reduction in pressure to draw fluid toward and into a pump inlet) will not result in phase change from liquid to gas. Thus, FIG. 2 shows that by cooling fluid at a given pressure, the fluid may be moved from a saturation curve and into a sub-cooled region. The pressure on such sub-cooled fluid (liquid) may be lowered somewhat without causing a phase change to gas. Accordingly, sub-cooled fluid may enter a pump inlet region of lower pressure without resulting in the formation of gas bubbles and pump cavitation.

Using thermal sub-cooling has the same advantages as the static head, but with the potential drawbacks of a larger heat exchanger to provide the sub-cooling and the potential for conditions that make system start-up very difficult, if the heat sink or heat exchanger temperature is greater than or equal to the fluid temperature.

FIG. 3 illustrates aspects of a third system 300 and method of producing sub-cooling. In system 300, the presence of a non-condensable gas is maintained over the liquid reservoir. In the example of FIG. 3, gassy sub-cooling of fluid allows some reduction in pressure without inducing a phase-change, wherein $T_0=T_1$ is and $P_0<P_1$. Such a non-condensable gas could be nitrogen, carbon dioxide, air (a mixture of gasses) or other gas or mixture, which will not condense at temperatures that are contemplated for system operation. Thus, within the container 302, the sum of the pressure components $P_0$ (pressure of the gaseous fluid) plus $P_G$ (pressure of the added gas, e.g., air) is approximately equal to a pressure $P_1$ of the liquid. Gassy sub-cooling is effectively artificial static head; i.e., the gas provides pressure, rather than a column of liquid (disregarding static head). Gassy sub-cooling may be an effective method for starting a pumping system. This method of gassy sub-cooling ensures the pump will always have the NPIPR for generating discharge pressure but the boiling and condensing temperatures will be increased and the heat exchanger will need to tolerate the air (or other gas), causing a larger, heavier, and more expensive heat exchanger.

The aspects discussed with respect to FIGS. 1-3 discuss elements which may be used in example systems of FIGS. 4-7. Regarding FIG. 1, using the static head advantageously will not affect the saturation temperature, heat exchanger performance, or the condensing temperature. However, static head utilization could increase system size and weight, and always reduces the chassis mobility spectrum. Regarding FIG. 2, use of thermal sub-cooling has the same advantages as the static head, but with the potential drawbacks of a larger heat exchanger to provide the sub-cooling and the potential for non-start conditions if the heat sink temperature is greater than or equal to the fluid temperature. Regarding FIG. 3, gassy sub-cooling advantageously ensures the pump will have the NPIPR for generating discharge pressure. However, the boiling and condensing temperatures will be increased and the heat exchanger will need to tolerate the air, requiring a larger, heavier, and more expensive heat exchanger.

Accordingly, the techniques and concepts of FIGS. 1-3 explain aspects of the example pumping systems of FIGS. 4-7.

Example Pumping Systems

Figure 4:
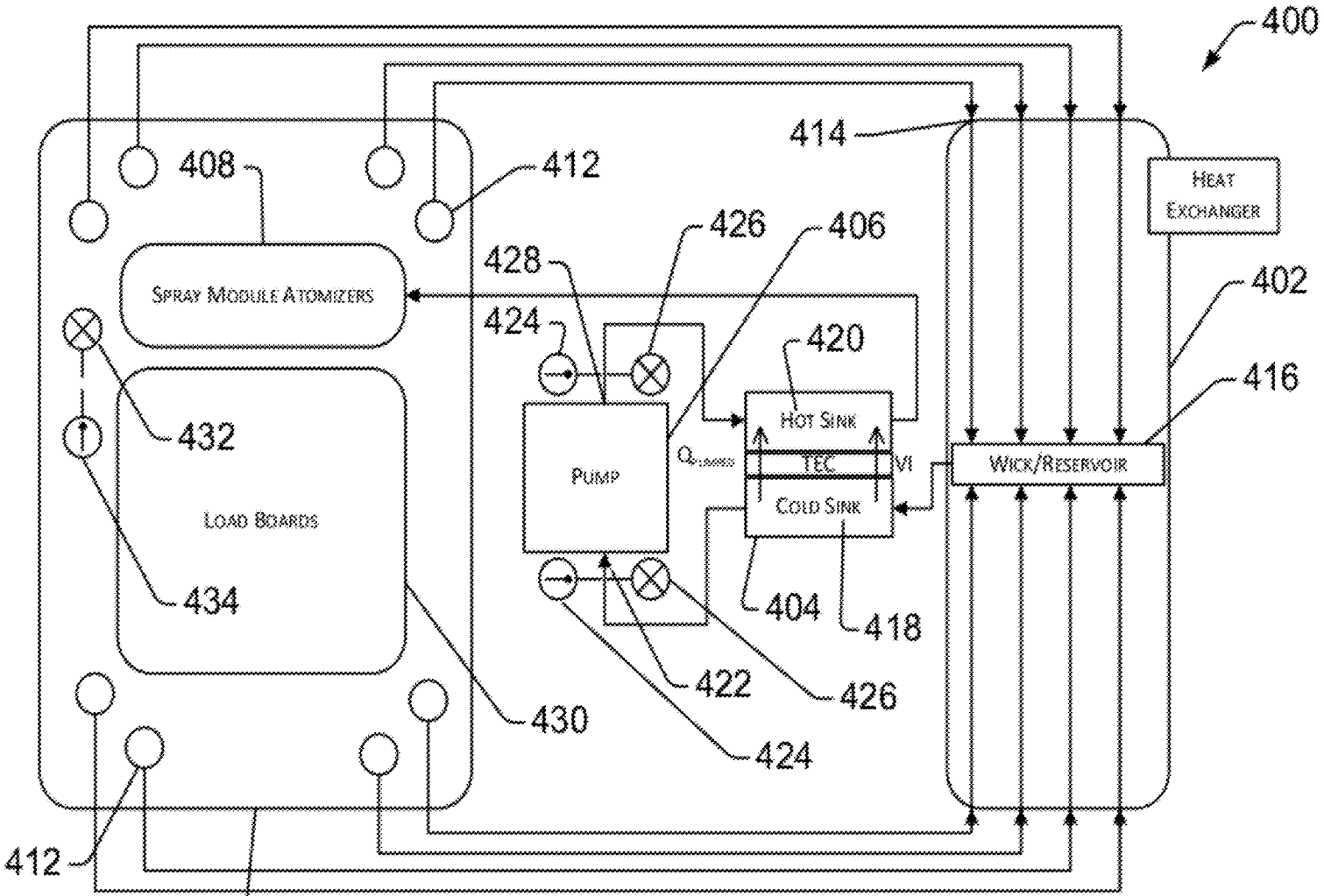
FIGS. 4-7 are diagrams illustrating example pumping systems, wherein the pumping systems are associated, for purposes of example only, to a passive fluid recovery system that provides cooling to an electronic load.

FIGS. 4-7 are diagrams illustrating example pumping systems. The pumping systems are associated, for purposes of example and illustration only, to a passive fluid recovery system that provides cooling to an electronic load. Referring to FIG. 4, an example of a pumping system 400 is shown. The system 400 includes a heat exchanger 402 to cool and condense fluid, such as from a gaseous state to a liquid state. The cooled liquid, which may be saturated (i.e., near the boiling point, based on temperature and pressure), may be piped to a thermal sub-cooling device 404. The thermal sub-cooling device 404 is configured to cool the fluid, before it is transferred to a pump 406. The pump 406 provides fluid under pressure to the thermal sub-cooling device 404, where the fluid is heated. The heated fluid, still pressurized by the pump, is directed to spray module atomizers 408 within an enclosure 410. The enclosure 410 may house electronics or other devices requiring cooling and/or fluid circulation. Fluid from within the enclosure 410 may be exhausted through a plurality of ports 412, and returned to the heat exchanger 402.

The heat exchanger 402 may be cooled by air or other means, as indicated by circumstances of a particular application. For example, an air-cooled heat exchanger 402 may be actively cooled (such as by a fan) or passively cooled (such as by passive air flow). In one implementation, each exhaust port 412 in the enclosure 410 may be individually connected to an associated inlet 414 on the heat exchanger. Alternatively, all exhaust ports 412 of the enclosure 410 may be connected to a single tube, pipe or conduit, and output from that tube directed to one or more inlets in the heat exchanger 402. In either configuration, a mixture of gas and liquid may enter each of a plurality of inlets 414 of the heat exchanger, whereupon the gas portion of the fluid is condensed to liquid by removal of heat. The condensed fluid may be temporarily stored in a wick/reservoir 416. Storing fluid at the reservoir 416 locates that fluid closer to the pump than an alternative design, wherein fluid stored in the enclosure 410. Because fluid is stored close to the pump, less sub-cooling of that fluid is required to move the fluid to the pump without some of the fluid undergoing a phase change from liquid to gas. Additionally, withdrawal of fluid from the reservoir 416 tends to draw fluid from the enclosure 410 to the heat exchanger 402, thereby assisting fluid circulation during start-up conditions.

The thermal sub-cooling device 404 may be an active heat pump or similar device. The thermal sub-cooling device 404 functions to sub-cool fluid obtained from the reservoir 416 of the heat exchanger 402. The sub-cooled fluid may then be pumped by the pump 406. It is significant to note that fluid leaving the reservoir 416—even if fully condensed into a liquid state—may vaporize into a gaseous state due to the lowering of pressure at the pump inlet associated with operation of the pump. Moreover, if the temperature of the reservoir 416 is greater than the temperature of the enclosure 410 and contents, this problem may be exacerbated. However, when sub-cooled by the thermal sub-cooling device 404, the fluid stays in liquid form as it moves through the pump 406.

In one implementation, the thermal sub-cooling device 404 is a thermo-electric cooler (TEC). The TEC 404 may include a cold sink 418 and a hot sink 420. The cold sink 418 is colder than the hot sink 420; i.e., heat is pumped from the cold sink to the hot sink. Fluid leaving the reservoir 416 may enter the cold sink 418 of the thermal sub-cooling device 404. Removal of heat from the fluid by the cold sink 418 is analogous to the action seen in FIG. 2, wherein fluid moves into the sub-cooled range of the saturation curve graph.

The sub-cooled fluid may exit the cold sink 418 of the thermal sub-cooling device 404 and enter the pump 406 at inlet 422. Movement of the fluid from the cold sink 418 to the inlet 422 of the pump 406 is stimulated by the fact that the pump inlet 422 is of lower pressure than the pressure within the cold sink 418. Significantly, the fluid may remain in the liquid state, as it moves to the pump inlet 422, due to the sub-cooling which resulted from the transfer of heat energy from the fluid into the cold sink 418. The temperature and pressure of the fluid may be measured by sensor/gauges 424, 426 at the inlet 422 of the pump 406.

Operation of the pump 406 exhausts fluid from pump outlet 428 at a pressure higher than that of the pump inlet 422. Accordingly, the fluid will be more highly pressurized, and will therefore remain in the liquid state. Fluid leaving the pump may be delivered to the hot sink 420 of the thermal sub-cooling device 404. At the hot sink 420, the fluid is heated. In particular, heat extracted from the fluid at the cold sink 418 is returned to the fluid, along with any operating inefficiencies of the thermal sub-cooling device 404. The process of heating fluid in the hot sink 420 will not result in a liquid to gas phase change, due to the elevated pressure of the fluid leaving the pump 406. Accordingly, warmed liquid is delivered by the pump 406, through the hot sink 420, to the spray module atomizers 408.

At the spray module atomizers 408, the liquid is "atomized" into a fine spray having a large surface area, i.e., large numbers of small droplets will have a large surface area. The spray may contact one or more electronic devices 430 directly, which may be configured as electronic circuit "boards" that represent an electrical "load," or the liquid sprays or streams may be contained within cold plates which are attached to the loads, thereby cooling them indirectly. The electronic devices 430 may not be turned on, i.e., operational, because the fluid mass rate, i.e., the fluid mass per unit time, may not be great enough to safely remove the heat generated by the load. However, as will be seen in greater detail below, as power supplied to the pump 406 is increased, and as power supplied to the thermal sub-cooling device 404 is decreased, power may be supplied to the electronic devices 430. Temperature and pressure sensors 432, 434 may be used to gather information to assist in the regulation of power to the pump 406 and thermal sub-cooling device 404.

Figure 5:
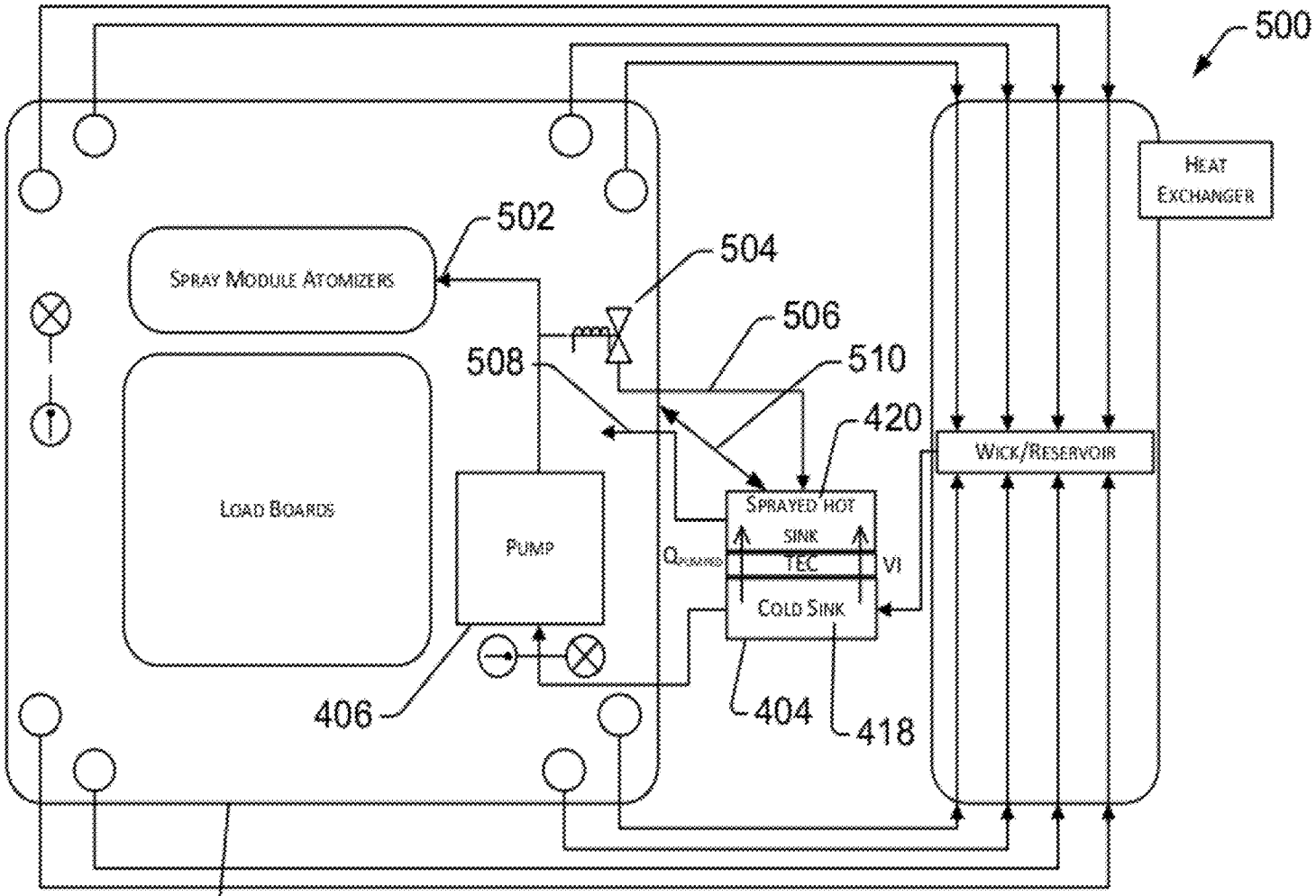

FIG. 5 shows a pumping system 500 having several differences with respect to the system 400 of FIG. 4. In particular, fluid output from the pump is delivered directly to the spray module atomizers by pipe 502. Accordingly, the step of heating the fluid before it is sprayed by the atomizers is not present. However, a valve 504 allows a portion of the fluid output from the pump to be diverted by conduit 506 to the hot sink 420 (i.e., the heated portion) of the thermal sub-cooling device 404 (e.g., a TEC or other thermal sub-cooling device). The valve 504, may be located outside the enclosure, if desired. Alternatively, the valve 504 and pump 406 (and other components, if desired) may be located within the enclosure 410. Conduit 506 may deliver a fluid as a spray, to cool the hot sink 420. Delivery of a spray to cool the hot sink 420 may absorb heat more effectively than simply allowing the fluid to flow from conduit 506 into the hot sink After absorbing heat from the hot sink 420, the fluid is exhausted by conduit 508 (optional if 406 is located within the enclosure 410) into the enclosure 410. Accordingly, the fluid passing through the heated portion 420 of the thermal sub-cooling device 404 and the fluid not passing through the heated portion of the thermal sub-cooling device enter the enclosure 410 at different temperatures. Conduit 508 may deliver fluid to any desired location within the enclosure 410, as indicated by the needs of a particular design application. Accordingly, the valve 504 may be used to regulate a level of heat energy transferred to the enclosure 410, and may be used to deliver heated fluid to portions of the enclosure other than the spray module atomizers.

In one optional embodiment, the hot sink 420 may be thermally connected 510 to the enclosure 410 or other object. The thermal connection 510 may be accomplished by a physical connection that transfers heat away from the hot sink 420. This heat transfer 510 may be in addition to, or as an alternative to, the spraying of the hot sink 420 with fluid.

Figure 6:
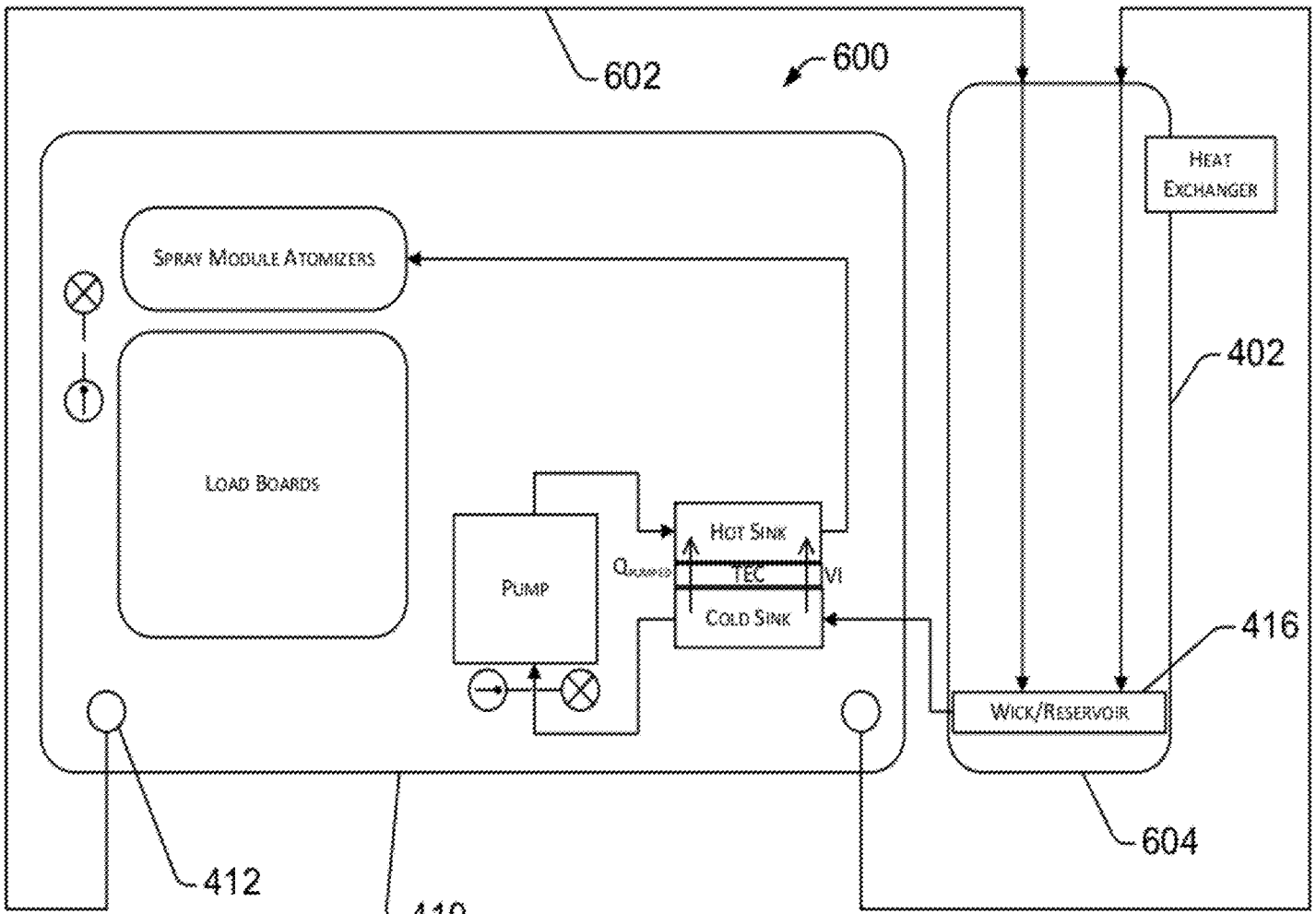

FIG. 6 shows a pumping system 600 having several differences with respect to the system 400 of FIG. 4. In particular, the system 600 is not intended for attitude independent operation. That is, the system must remain "right side up." Accordingly, the enclosure 410 includes fewer fluid exhaust ports 412, since only the "bottom" ports will drain fluid. This is intuitively true, since the lower ports will be more likely to drain fluid in liquid form, and use of upper ports would result in undesirable removal of fluid in gaseous form. With fewer exhaust ports 412, fewer conduits 602 are required deliver exhausted fluid to the heat exchanger 402. Additionally, since the system is maintained in a vertical or "right side up" configuration, the reservoir 416 may be located in the bottom portion 604 of the heat exchanger 402. This may result in a simpler and lower cost heat exchanger 402.

Figure 7:
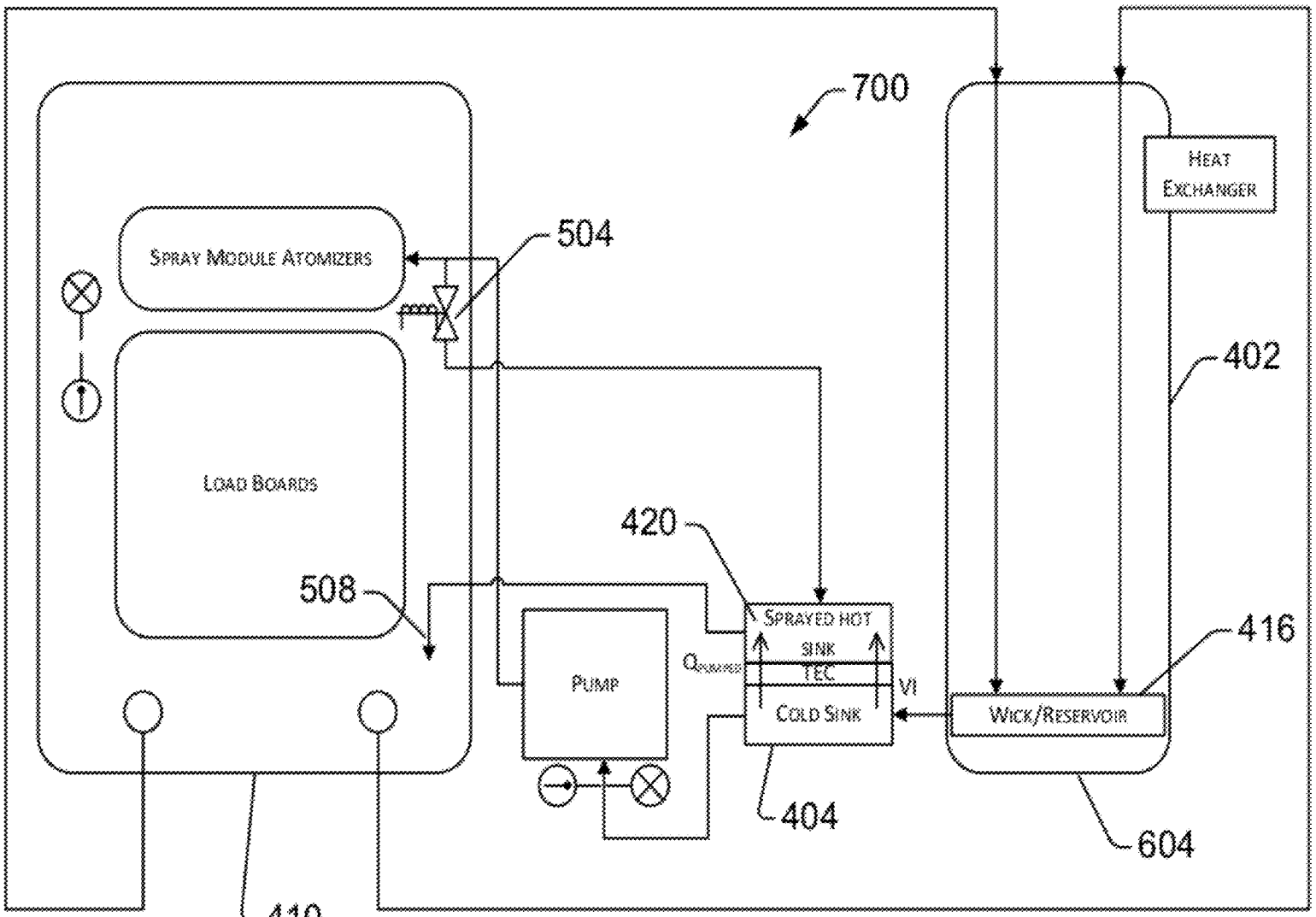

FIG. 7 combines aspects of FIGS. 4-6. Similarly to FIG. 6, the system 700 is not attitude independent, and requires a "right side up" orientation. Accordingly, the heat exchanger 402 includes a wick/reservoir 416 located in the bottom portion 604. Similarly to FIG. 5, a valve 504—located inside or outside the enclosure 410—may be provided to allow some or all of the fluid to be routed into the hot sink 420 of the thermal sub-cooling device 404. In the example of FIG. 5, the hot sink 420 may be spray cooled by fluid diverted by valve 504. The fluid, heated by the hot sink 420, may be reintroduced into a desired location of the enclosure 410 by conduit 508.

Further Discussion of Fluid in a Cooling System

Figure 8:
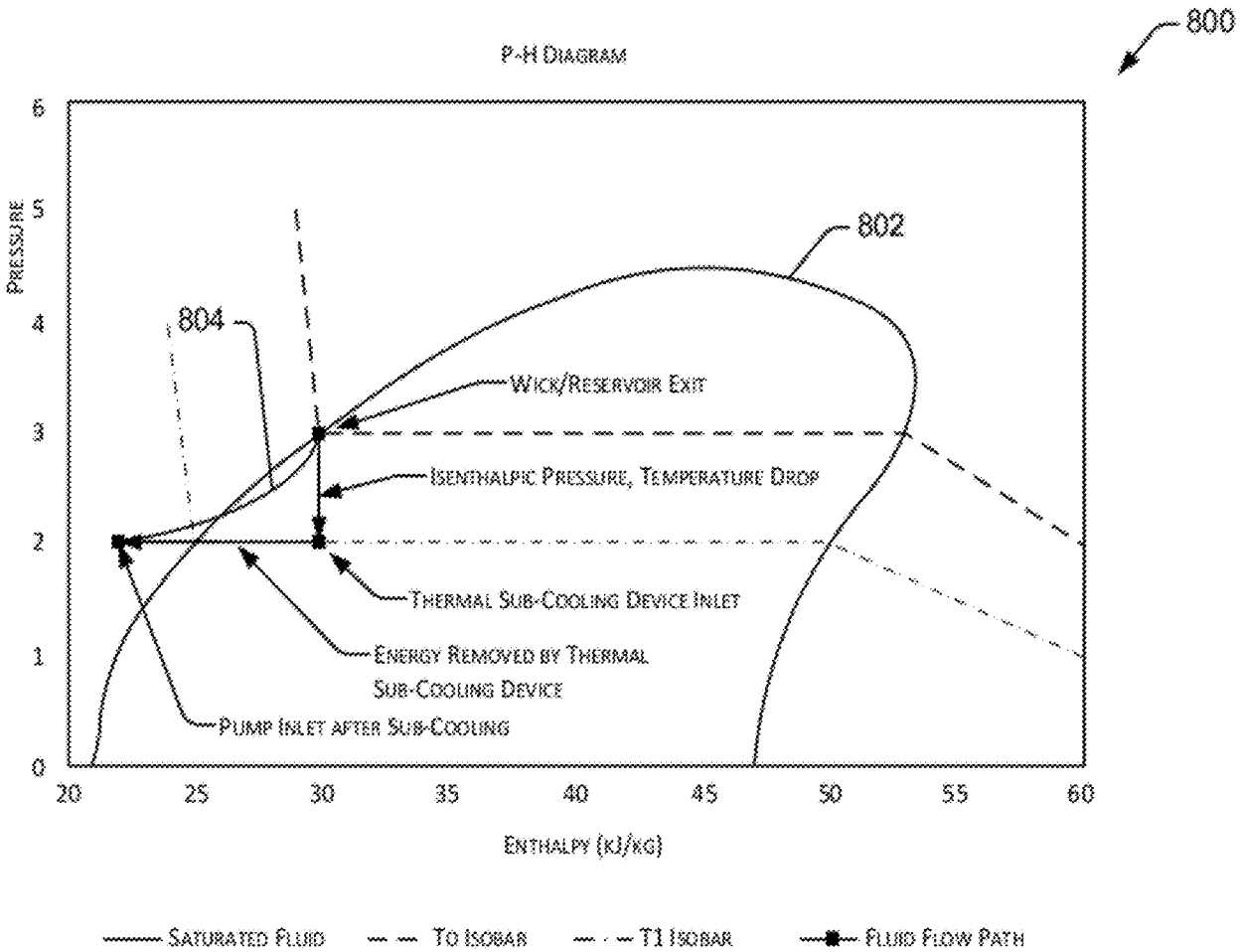
FIG. 8 is a P-H (pressure enthalpy) diagram, illustrating example aspects of fluid states, and particularly illustrating how sub-cooling can prevent pump cavitation.

FIG. 8 is a P-H (pressure enthalpy) diagram 800, illustrating aspects of fluid states, and particularly illustrating how sub-cooling can prevent pump cavitation. The diagram illustrates a vapor-pressure curve 802 along which fluid is saturated. As a result of the "saturation," any decrease in pressure and/or increase in temperature will result in phase change from liquid to gas.

The point on the diagram labeled "Wick/Reservoir Exit" describes fluid conditions at the exit of the wick 416 and/or at the pump pickup (seen as 416 in FIG. 4) without an operational thermal sub-cooling device (an example of which is seen as 404 in FIG. 4). This point is located on (or approximately on) the saturated fluid curve. Accordingly, if the pump causes a decrease in pressure—such as would be required to draw the fluid into the pump—some or all of the fluid may phase change from liquid to gas. In a typical situation, only some of the fluid would make the phase change; however, this could result in problematic cavitation of the pump.

The vertical transition within the diagram 800 labeled "isenthalpic pressure, temperature drop" illustrates a decrease in pressure on fluid, which is required to move the fluid from a reservoir to the moving components of the pump inlet 422 of FIG. 4. Assuming that no thermal sub-cooling device 404 exists, the pressure drop (indicated on diagram 800 by "isenthalpic pressure, temperature drop") will cause vapor to form prior to the fluid entering the pump inlet at 422. In this scenario, a mixed phase of liquid and vapor would enter the pump at the point labeled "Pump inlet without thermal sub-cooling device," resulting in cavitation.

With the thermal sub-cooling device, the fluid follows the curve labeled "Pressure, Temperature Drop With Energy Removed." The vertical component of the curve is still represented by the "Isenthalpic Pressure, Temperature Drop" while the horizontal component of the curve is represented by the horizontal line labeled "Energy removed by Thermal Sub-Cooling Device." The point on the diagram labeled "Pump Inlet after Sub-Cooling" describes the state of fluid entering the pump when the thermal sub-cooling device is present. In the context of the system 400 of FIG. 4, the point on the diagram corresponds with fluid entering the pump 406 after passing through the cold sink 418 of the thermal sub-cooling device 404.

The horizontal transition within the diagram 800 labeled "Energy Removed by Thermal Sub-Cooling Device" illustrates a decrease in enthalpy related to cooling of the fluid by the thermal sub-cooling device. In the context of the system 400 of FIG. 4, the horizontal transition on the diagram corresponds with fluid as it cools within the cold sink 418 of the thermal sub-cooling device 404. It is significant that the horizontal transition indicated on the diagram crosses the saturated fluid curve 802 of diagram 800. Accordingly, some of the fluid may change phase, from gas to liquid. However, the cold sink 418 of thermal sub-cooling device 404 extracts heat from the fluid, which is reflected in diagram 800 by the portion of the graph labeled "Energy Removed by Thermal Sub-Cooling Device." The cooling action of the cold sink "sub-cools" the fluid, i.e., the fluid becomes fully condensed as a liquid and then is sub-cooled, moving the P-H characteristics of the fluid outside the saturated fluid region defined by curve 802. Once cooled by the cold sink 418 the fluid is outside curve 802, at the location labeled "Pump Inlet After Sub-Cooling." The sub-cooled fluid remains in liquid form, even as a slight pressure drop draws it into the pump. Accordingly, pump cavitation is avoided.

Example Operational Algorithms

Figure 9:
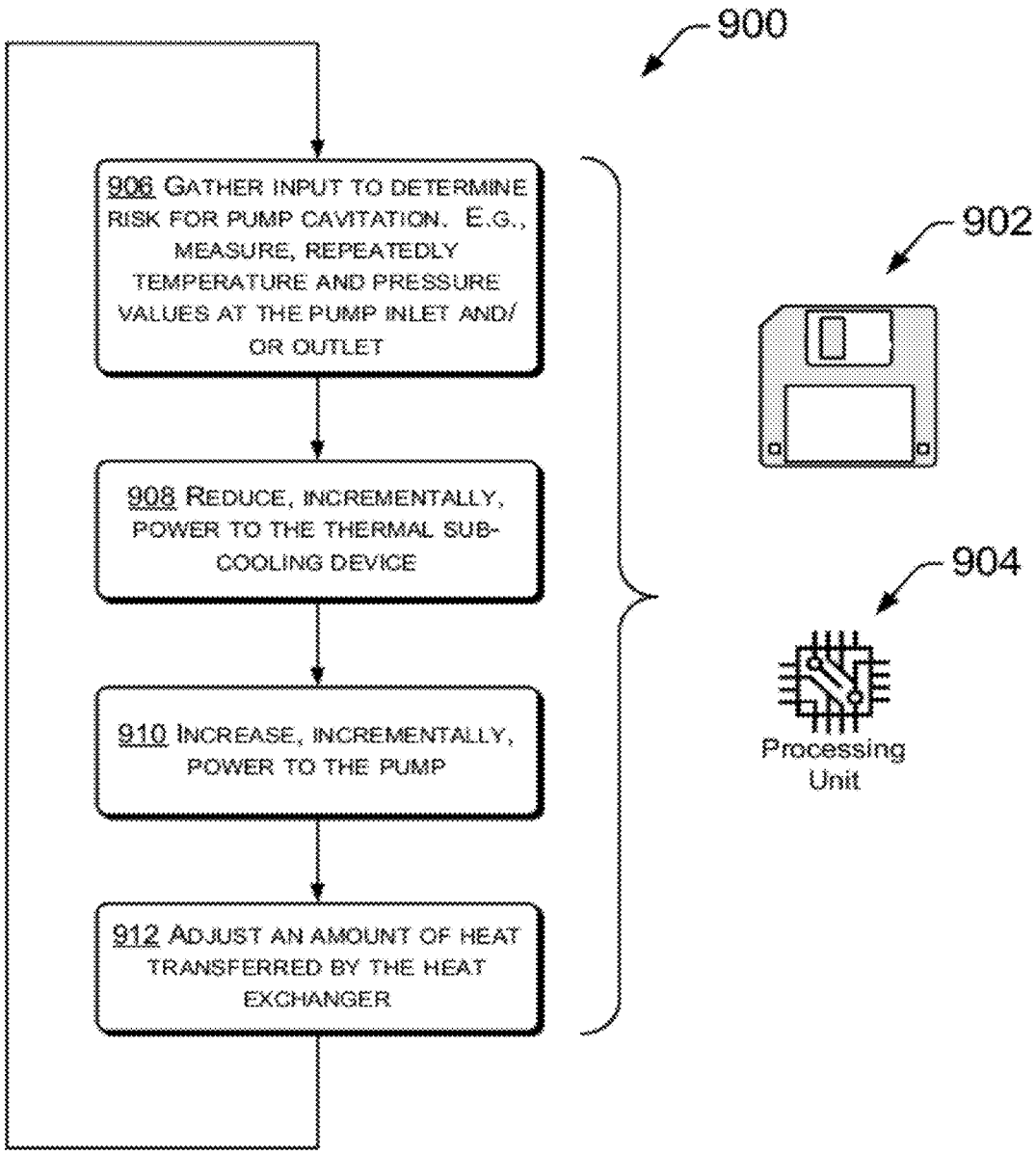
FIGS. 9-10 are flow diagrams, illustrating example start-up algorithms adapted for use with a pumping system, optionally adapted to an environment of a passive fluid recovery system.
Figure 10:
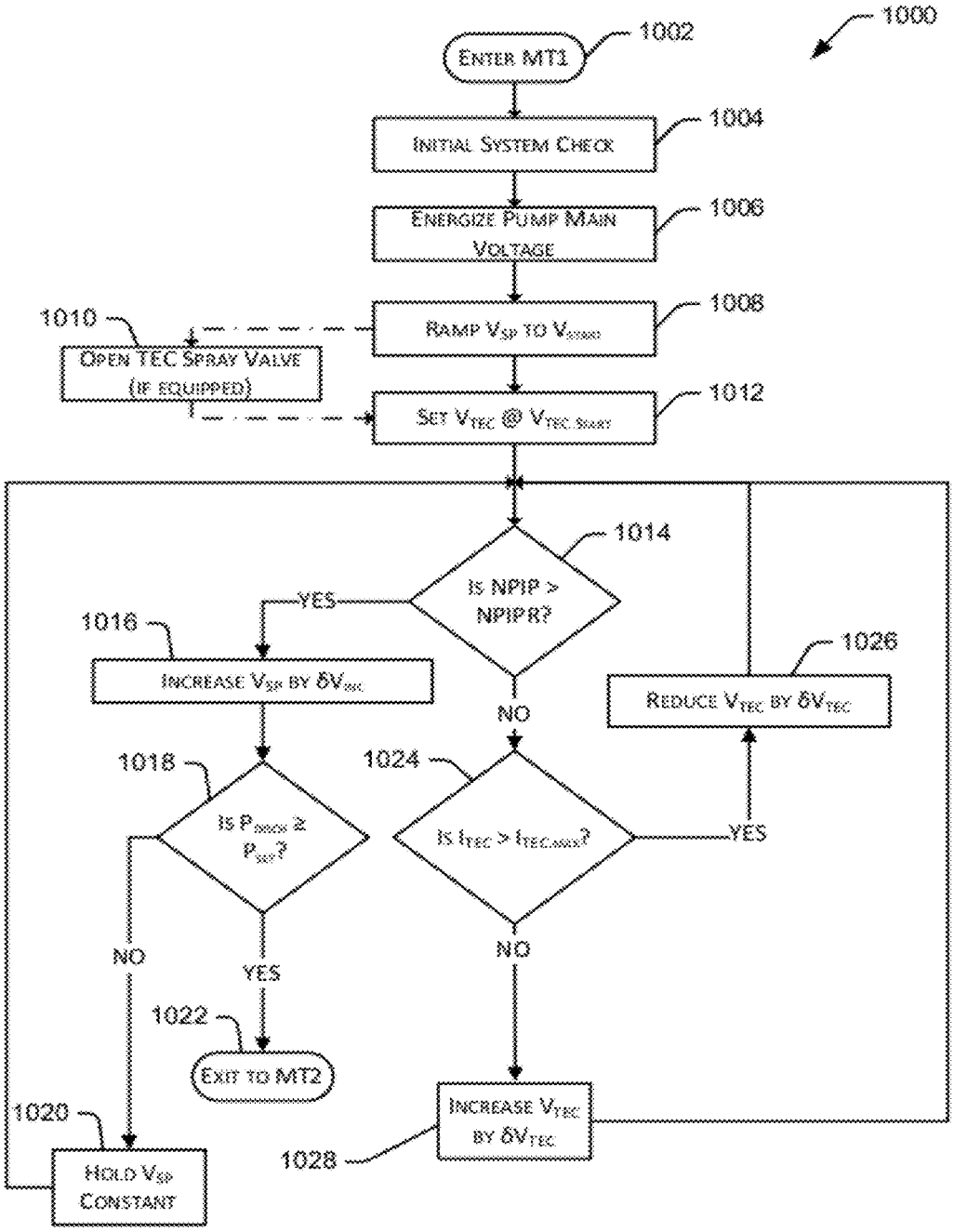
Figure 11:
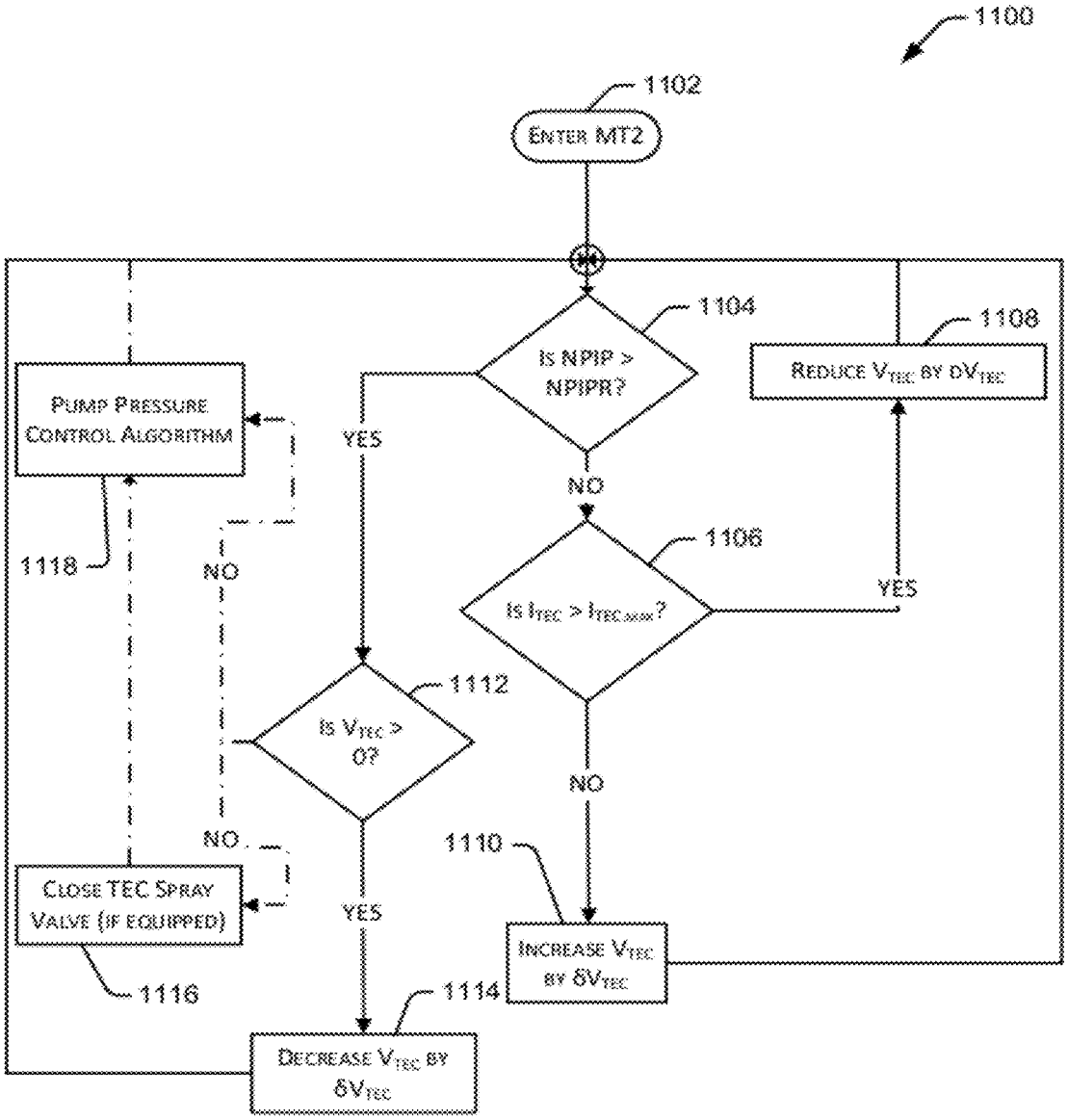
FIG. 11 is a flow diagram, illustrating an example normal operating algorithm adapted for use with a pumping system, optionally adaptable to an environment of a passive fluid recovery system.

FIGS. 9-11 are flow diagrams illustrating example processes for operation of a pumping system. The example processes of FIGS. 9-11 can be understood in part by reference to the configurations of FIGS. 1-8. However, FIGS. 9-11 contain general applicability, and are not limited by other drawing figures and/or prior discussion.

Each process described herein is illustrated as a collection of blocks or operations in a logical flow graph, which represent a sequence of operations that can be implemented in hardware, software, or a combination thereof. In the context of software, the operations represent computer-executable instructions stored on one or more computer-readable storage media 902 that, when executed by one or more processors 904, perform the recited operations. Such storage media 902, processors 904 and computer-readable instructions can be located within the system 400, or in an alternative location, according to a desired design or implementation. The storage media 902 seen in FIG. 9 is representative of storage media generally, both removable and non-removable, and of any technology. Thus, the recited operations represent actions, such as those described in FIGS. 9-11, and are taken under control of one or more processors configured with executable instructions to perform actions indicated. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the process. The above discussion may apply to other processes described herein.

FIG. 9 is an example flow diagram, illustrating an example algorithm 900 adapted for use with a pumping system and/or passive fluid recovery system. Each step of the algorithm may or may not require execution on each iteration of the algorithm, and between zero and many iterations may be required, depending on circumstances. The algorithm may have application during start-up and/or operation of the system. The example algorithm 900 may not be required and/or indicated in some systems. That is, in some systems it may be possible to turn on the pump and thermal sub-cooling device to a desired power level without incremental power changes. In particular, within systems, the relative sizes of components such as the pump and thermal sub-cooling device, the fluid used, ambient temperatures encountered, and other factors may or may not indicate use of the method steps of algorithm 900. At operation 906, input is gathered to determine risk for, and/or actual, pump cavitation. This may be accomplished by a number of means. For example, temperature and pressure are measured at the pump inlet and/or outlet. This process may be performed repeatedly, during the start-up process. Referring to the example pumping system 400 of FIG. 4, the pump 406 has an inlet 422 and outlet 428. Temperature and pressure sensors and gauges 424, 426 are configured to measure the temperature and pressure at the inlet 422 and/or outlet 428 of the pump 406.

At operation 908, power to the thermal sub-cooling device is reduced in an incremental manner. The reduction in power to the thermal sub-cooling device may be made according to one or more values used in a calculation. The values may include: a net positive inlet pressure of the pump; a net positive inlet pressure of the pump required; and a spray pump discharge pressure set point. These values may be evaluated during start-up conditions. In one example, the power to the thermal sub-cooling device is reduced in an incremental manner that keeps a net positive pressure at an inlet of the pump greater than a net positive pump inlet pressure of the pump that is required. Referring again to the example of FIG. 4, power to the thermal sub-cooling device 404 may be incrementally reduced during the start-up process. As noted above, sub-cooling of fluid may be required, to avoid pump cavitation. Initially, the sub-cooling is provided by the thermal sub-cooling device, particularly where the system 400 is of uniform temperature. As the system 400 begins to operate, the heat exchanger 402 is better able to sub-cool fluid, and less sub-cooling is required by the thermal sub-cooling device 404. Accordingly, power can be reduced to the thermal sub-cooling device 404 in an incremental manner.

At operation 910, power to the pump is incrementally increased. The increasing may be calculated to maintain net positive pump inlet pressure greater than net positive pump inlet pressure required. Referring again to the example of FIG. 4, at initial start-up, the system 400 may be uniform in temperature. Application of excessive power to the pump 406 may result in excessive reduction of fluid pressure at the pump inlet, phase change from fluid to gas, and pump cavitation. However, sub-cooling due to operation of the thermal sub-cooling device 404 and incremental increases in power supplied to the pump 406 allow the pump to operate without cavitation.

At operation 912, an amount of heat transferred by the heat exchanger may be adjusted. In one example, an amount of heat transferred (e.g., rejected, such as rejected into the environment) by the heat exchanger 402 of FIG. 4 may be adjusted and/or regulated. The adjustment and/or regulation may be performed by any of many techniques. For example, a speed of a condenser fan cooling the heat exchanger may be regulated, such as by control over an input power or voltage. Alternatively, a shutter blocking the air flow of the fan or a ram air heat exchanger may be regulated. And further, an external resource may be commanded, such as by operation of a valve, to reduce or regulate water or coolant supplied to the heat exchanger.

In one example, operations 906-912 may be repeated during a start-up process. As power to the pump increases and heat is released by a thermal load, the heat exchanger is better able to remove heat from the system. As the heat exchanger functions more effectively, power supplied to the thermal sub-cooling device can be reduced. A steady state may be achieved when full or appropriate power is applied to the pump, and minimal or no power is applied to the thermal sub-cooling device. During the start-up process, the speed with which the incremental changes can be made may depend on the repeated temperature and pressure measurements, which indicate how rapidly power may be reduced to the thermal sub-cooling device and how rapidly power may be increased to the pump. The temperature and pressure measurements may depend on how rapidly heat is being produced by the load boards 430, how rapidly heat is being lost by the system 400, and other factors.

The algorithm 900 may be adapted to non-start-up operation. For example, a heat-producing load, such as load boards 430 of FIG. 4, may produce less heat than is needed to allow efficient operation of the heat exchanger and to prevent pump cavitation. Under such conditions, the thermal sub-cooling device can be operated, optionally as indicated by algorithm 900.

FIG. 10 is a flow diagram describing an example startup algorithm 1000, optionally adaptable for use within an environment of passive fluid recovery system. At operation 1002, a start-up algorithm (e.g., "main task 1" or MT1) is started. At operation 1004, an initial system check is performed. The initial system check may include obtaining measurements of: $I_{TEC}$=TEC current; $P_{disch}$=spray pump discharge pressure; $P_{pump\ in}$=spray pump inlet pressure; $P_{vap}$=vapor space pressure; $T_{pump\ in}$=pump inlet temperature; $T_{pump\ out}$=pump outlet temperature; $V_{SP}$=spray pump control voltage; and $V_{TEC}$=TEC voltage. The initial system check may also include calculation of values, including: NPIP=net positive inlet pressure; NPIPR=net positive inlet pressure required; $P_{disch\ sat}$=saturation pressure at the pump outlet based on $T_{pump\ out}$; and $P_{Sat\ Pump\ In}$=saturation pressure at the pump inlet based on $T_{pump\ in}$. NPIP may be calculated as $P_{pump\ in}-P_{sat.\ pump\ in}$. NPIPRH $(N_{pump})^{0.5}$ may be determined by a lookup table. The initial system check may also include temporary user settable values, including: $V_{TEC}$=incremental change in TEC voltage; deltaV$_{inc}$=incremental change in pump voltage on start up ramp; $I_{TEC\ max}$=maximum TEC current; $P_{set}$=spray pump discharge pressure setpoint; $V_{start}$=pump startup control voltage; and $V_{TEC\ start}$=startup voltage for TEC.

At operation 1006, the main pump voltage is energized. Referring to the example of FIG. 4, a voltage is applied to the pump 406. At operation 1008, the $V_{SP}$ voltage is ramped to $V_{start}$. That is, the measure value of the spray pump (e.g., pump 406 of FIG. 4) is ramped up to the level of $V_{start}$. At operation 1010, the TEC spray valve is opened, if such a valve is available. In the examples of FIGS. 5 and 7, the solenoid controlled valve 504 is opened. Opening this value routes part of the fluid output by pump 406 into the thermal sub-cooling device 404. At operation 1012, the $V_{TEC}$ is set to $V_{TEC\ start}$.

At operation 1014, a determination is made if NPIP>NPIPR. In particular, it is determined if the net positive inlet pressure (of the pump inlet) is greater than the net positive input pressure required (of the pump). If the inequality is true, then operation of the pump, which tends to lower pressure to pull the fluid into the pump, will not result in a liquid-to-gas phase change, and associated pump cavitation. Accordingly, if the inequality is true, at operation 1016 the voltage to the pump ($V_{SP}$) can be increased by an incremental amount (deltaV$_{inc}$). At operation 1018, a determination is made if the spray pump discharge pressure ($P_{disch}$) is greater than or equal to the spray pump discharge pressure set point ($P_{set}$). If it is not, then at operation 1020, the voltage to the spray pump (e.g., pump 406 of FIG. 4) is held constant. If it is (i.e., if the spray pump voltage is at an operational level), then at operation 1022, the operational algorithm MT2 (main task 2) is entered.

At operation 1014, it is possible that the net positive inlet pressure is not greater than the net positive input pressure required (of the pump). This means that increased power to the pump may result in fluid pressure that is too low at the pump inlet, and therefore the risk of phase change to gas and pump cavitation. Accordingly, at operation 1024 a determination is made if $I_{TEC}>I_{TEC\ max}$. In particular, it is determined if current to the heat exchange device (e.g., the thermal sub-cooling device 404 of FIG. 4) is greater than a maximum TEC current value. If the inequality is true, at operation 1026 the voltage $V_{TEC}$ may be reduced by delta $V_{TEC}$. If the inequality is false, the voltage to the thermal sub-cooling device (e.g., a TEC) may be increased at operation 1026.

The algorithm 1000 of FIG. 10 may be repeated until the startup phase is complete. Generally, this will result in heat production by a current-consuming load and heat dissipation by a heat exchanger. At this point, the algorithm will exit at operation 1022 to the operational algorithm of FIG. 11.

FIG. 11 is a flow diagram describing an example normal operating algorithm 1100, which is implemented after a start up operation, as seen in FIGS. 9-10. The algorithm 1100 is optionally adaptable for use within an environment of passive fluid recovery system. At operation 1102, the algorithm is entered, at main task 2. Operations 1102-1110 are substantially similar to their corresponding operations in FIG. 10.

At operation 1112, a determination is made if the voltage to the thermal sub-cooling device is greater than zero. If so, at operation 1114 the $V_{TEC}$ is decreased by an incremental or delta value. If not, at operation 1116 the TEC spray valve (if present) is closed. For example, valve 504 in FIG. 5 is closed. This prevents return of fluid to the thermal sub-cooling device. At operation 1118, a pump pressure control algorithm is entered. Thus, when the thermal sub-cooling device (e.g., the TEC) is not operational, the pump pressure control algorithm is implemented and followed.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims

What is claimed is:

1. A pumping system, comprising:

a thermal sub-cooling device comprising a cooled portion and a heated portion;

a pump having an inlet and an outlet, the inlet configured to receive sub-cooled fluid cooled by the cooled portion of the thermal sub-cooling device; and a controller to execute a start-up procedure, the start-up procedure comprising instructions for:

gathering input to determine risk for pump cavitation; and reducing a rate at which power is supplied to the thermal sub-cooling device and increasing a rate at which power is supplied to the pump according to the gathered inputs, wherein the reducing and the increasing transition the pumping system from a start-up state to an operational state.

2. The pumping system of claim 1, additionally comprising instructions for:

increasing a rate at which power is supplied to the pump, wherein the increasing is calculated to maintain net positive pump inlet pressure greater than a net positive pump inlet pressure required.

3. A pumping system, comprising:

a thermal sub-cooling device comprising a cooled portion and a heated portion;

a pump having an inlet and an outlet, the inlet configured to receive sub-cooled fluid cooled by the cooled portion of the thermal sub-cooling device; and a controller to execute a start-up procedure, the start-up procedure comprising instructions for:

reducing a rate at which power is supplied to the thermal sub-cooling device during the start-up procedure, by incremental steps, to reduce a rate at which heat is removed by the thermal sub-cooling device from fluid received at the inlet of the pump; and increasing a rate at which power is supplied to the pump, by incremental steps, wherein the increasing maintains net positive pump inlet pressure greater than net positive pump inlet pressure required.

4. The pumping system of claim 1, additionally comprising a valve to divide output of the pump between a portion that passes through the heated portion of the thermal sub-cooling device and a portion that does not pass through the heated portion of the thermal sub-cooling device.

5. The pumping system of claim 1, wherein the outlet of the pump is configured to provide fluid to the heated portion of the heat transfer device.

6. A pumping system, comprising:

an enclosure configured to contain fluid in both gas and liquid states;

a thermal sub-cooling device comprising a cooled portion and a heated portion;

a pump having a pump inlet and a pump outlet, the pump inlet configured to receive fluid cooled by the cooled portion of the thermal sub-cooling device and the pump outlet configured to provide fluid for transfer through the heated portion of the thermal sub-cooling device and into the enclosure; and a controller to execute instructions for:

repeatedly measuring temperature and pressure values at the pump inlet; and reducing by increments a rate at which power is supplied to the thermal sub-cooling device and increasing by increments a rate at which power is supplied to the pump according to the repeated measurements, wherein the reducing and the increasing does not result in liquid to gas phase change in fluid at the pump inlet.

7. The pumping system of claim 6, additionally comprising instructions for:

increasing power supplied to the pump at a rate that maintains net positive pump inlet pressure greater than a net positive pump inlet pressure required.

8. A pumping system, comprising:

an enclosure configured to contain fluid in both gas and liquid states;

a thermal sub-cooling device comprising a cooled portion and a heated portion;

a pump having a pump inlet and a pump outlet, the pump inlet configured to receive fluid cooled by the cooled portion of the thermal sub-cooling device and the pump outlet configured to provide fluid for transfer by the heated portion of the thermal sub-cooling device and into the enclosure; and a controller to execute a start-up procedure, the start-up procedure comprising instructions for:

reducing, by incremental steps, a rate at which power is supplied to the thermal sub-cooling device during the start-up procedure to reduce a rate at which heat is removed by the thermal sub-cooling device from fluid received at the inlet of the pump; and increasing, by incremental steps, a rate at which power is supplied to the pump, wherein the increasing maintains net positive pump inlet pressure greater than net positive pump inlet pressure required.

9. The pumping system of claim 6, additionally comprising a valve to divide output of the pump between fluid passing through the heated portion of the thermal sub-cooling device and fluid not passing through the heated portion of the thermal sub-cooling device, wherein the fluid passing through the heated portion of the thermal sub-cooling device and the fluid not passing through the heated portion of the thermal sub-cooling device enter the enclosure at different temperatures.

10. The pumping system of claim 6, wherein the thermal sub-cooling device is a thermo-electric cooler, and wherein heat is transferred from the cooled portion to the heated portion.

11. A fluid recovery system, comprising:

an enclosure configured to contain fluid in both gas and liquid states;

a plurality of ports defined within the enclosure to remove fluid from the enclosure;

a heat exchanger, to receive fluid removed from the ports, to remove heat from fluid, and to condense the fluid;

a thermal sub-cooling device to cool fluid output from the heat exchanger;

a pump to input fluid cooled by the thermal sub-cooling device, and to output fluid to the enclosure; and a controller to regulate power supplied to the thermal sub-cooling device and power supplied to the pump, wherein during a start-up procedure power is lowered in increments to the thermal sub-cooling device and power is increased in increments to the pump.

12. The fluid recovery system of claim 11, wherein at least some of the fluid output to the enclosure is heated by the thermal sub-cooling device.

13. The fluid recovery system of claim 11, wherein the thermal sub-cooling device is a thermo-electric cooler that heats at least some of the fluid output to the enclosure by the pump.

14. The fluid recovery system of claim 11, wherein the heat exchanger defines a region within which a reservoir of fluid may be contained.

15. A fluid recovery system, comprising:

an enclosure configured to contain fluid in both gas and liquid states;

a plurality of ports defined within the enclosure to remove fluid from the enclosure;

a heat exchanger, to receive fluid removed from the ports, to remove heat from fluid, and to condense the fluid;

a thermal sub-cooling device to cool fluid output from the heat exchanger;

a pump to input fluid cooled by the thermal sub-cooling device, and to output fluid to the enclosure; and a controller to regulate power supplied to the thermal sub-cooling device according to values input to the controller, the values comprising:

a net positive inlet pressure of the pump; and a net positive inlet pressure of the pump required.

16. A fluid recovery system, comprising:

an enclosure configured to contain fluid in both gas and liquid states;

a plurality of ports defined within the enclosure to remove fluid from the enclosure;

a heat exchanger, to receive fluid removed from the ports, to remove heat from fluid, and to condense the fluid;

a thermal sub-cooling device to cool fluid output from the heat exchanger; and a pump to input fluid cooled by the thermal sub-cooling device, and to output fluid to the enclosure; and a controller, to regulate power supplied to the thermal sub-cooling device, and to regulate power supplied to the pump, according to values input to the controller, the values comprising:

a net positive inlet pressure of the pump;

a net positive inlet pressure of the pump required;

a spray pump discharge pressure set point; and wherein the input values are evaluated during start-up conditions.

17. The fluid recovery system of claim 11, wherein the heat exchanger is configured to adjust an amount of heat transferred by the heat exchanger.

* * * * *